US005910166A

United States Patent [19]

Mitchell et al.

[11] Patent Number: 5,910,166

[45] Date of Patent: Jun. 8, 1999

[54] REFRIGERATION SYSTEM AND A CAPILLARY TUBE THEREOF

[75] Inventors: Alan J. Mitchell; Brent A. Junge, both of Evansville, Ind.

[73] Assignee: Whirlpool Corporation, Benton Harbor, Mich.

[21] Appl. No.: 08/977,964

[22] Filed: Nov. 25, 1997

[51] Int. Cl.[6] ..... F25B 41/06

[52] U.S. Cl. ..... 62/511; 138/45

[58] Field of Search ..... 62/511, 527, 324.6; 138/40, 43, 45

[56] References Cited

U.S. PATENT DOCUMENTS

| | | | |
|---|---|---|---|
| 2,418,671 | 4/1947 | Schweller | 62/8 |
| 2,674,105 | 4/1954 | Prosek | 62/511 |
| 3,531,947 | 10/1970 | Drury et al. | 62/511 |
| 3,967,489 | 7/1976 | Pohl et al. | 72/367 |
| 4,408,467 | 10/1983 | Murname et al. | 62/296 |
| 4,445,343 | 5/1984 | McCarty | 62/324.1 |
| 4,793,150 | 12/1988 | Wattley et al. | 62/296 |
| 5,345,780 | 9/1994 | Aaron et al. | 62/324.6 |
| 5,743,111 | 4/1998 | Sasaki et al. | 62/511 |

*Primary Examiner*—John M. Sollecito
*Attorney, Agent, or Firm*—Robert O. Rice; Andrea Powers-Denklau

[57] ABSTRACT

A varying cross-sectional area capillary tube for a refrigeration system. The capillary tube comprises at least a first portion and a second portion. The first portion has a cross-sectional area that is effectively smaller than the cross-sectional area of the second portion. By doing so, any contaminants contained in the refrigerant will deposit themselves within the second portion of the capillary tubes, but because of the increased cross-sectional area, will not clog the capillary tube.

24 Claims, 1 Drawing Sheet

REFRIGERATION SYSTEM AND A CAPILLARY TUBE THEREOF

BACKGROUND OF THE INVENTION

1. Field of the Invention

The invention is directed to a refrigeration system using a capillary tube as a restriction device, and, more specifically, to a capillary tube having a variable inner cross-sectional area to prevent deposits of contaminants from the refrigerant from clogging the capillary tube.

2. Description of the Related Art

Contemporary refrigeration systems are well known and understood. Typically, a conventional refrigeration system comprises a compressor, condenser, restriction device, and evaporator all connected in series. The condenser is connected to the outlet or high pressure side of the compressor, whereas the evaporator is connected to the inlet or suction side of the compressor. The restriction device, such as a capillary tube, connects the condenser to the evaporator.

In operation, the compressor compresses a refrigerant and expels it into the condenser. The flow of the refrigerant is restricted as it encounters the capillary tube, resulting in an increase in the pressure of the refrigerant in the condenser. As the compressed and high pressure refrigerant exits the capillary tube and enters the low pressure and greater volume environment of the evaporator, the refrigerant expands and boils, resulting in a temperature decrease in the evaporator. The refrigerant, now generally in a gaseous state, then moves toward the compressor, where it is once again compressed and the cycle repeated. In some systems, the capillary tube and the tube that returns the refrigerant to the compressor are soldered together to form a heat exchanger (often called a suction line heat exchanger ). This improves the energy efficiency of the refrigeration system.

One disadvantage of this process is that during the expansion of the refrigerant as it leaves the capillary tube and enters the evaporator, the change of state of the refrigerant from a liquid to a gas and its associated temperature decrease results in contaminants contained in the refrigerant being deposited within a portion of the capillary tube near the junction of the evaporator. Over time, these deposits can result in a clogging of the capillary tube and a reduction in performance of the refrigeration system. The problem of contaminants clogging the capillary tube is much worse when using newer refrigerants, such as R-134A (HFC). The HFC systems are particularly vulnerable to hydrocarbon contaminants, especially paraffins, which can clog the sealed refrigeration system, causing it to fail.

SUMMARY OF THE INVENTION

Applicants' invention provides a refrigeration system with a capillary tube that overcomes the problem of the contaminants clogging the capillary tube. The invention solves the problem associated with the prior art by providing a capillary tube having a variable internal diameter or variable internal cross section, which permits the contaminants in the refrigerant to be deposited in a larger diameter portion of the capillary tube, effectively preventing the clogging of the capillary tube.

In a preferred embodiment, the capillary tube has an inlet connected to a condenser outlet and an outlet connected to an evaporator inlet. The capillary tube has a varying cross-sectional area with at least a first cross-sectional area and a second cross-sectional area, which is greater than the first cross-sectional area. The first cross-sectional area is near the capillary tube inlet and the second cross-sectional area is near the capillary tube outlet. As a refrigerant flows through the capillary tube from a condenser to an evaporator, contaminants in the refrigerant will tend to deposit in the second cross-sectional area of the capillary tube instead of the first cross-sectional area of the capillary tube, effectively preventing the capillary tube from being clogged by the contaminant.

Preferably, the ratio of the first cross-sectional area to the second cross-sectional area is greater than 1.2 and less than 2.0 to insure that the contaminants will deposit in the second cross-sectional area of the capillary tube without permitting the second cross-sectional area from acting like the evaporator.

BRIEF DESCRIPTION OF THE DRAWINGS

FIG. I is a schematic view of a refrigeration system according to the invention.

DESCRIPTION OF THE PREFERRED EMBODIMENT

Figure 1:
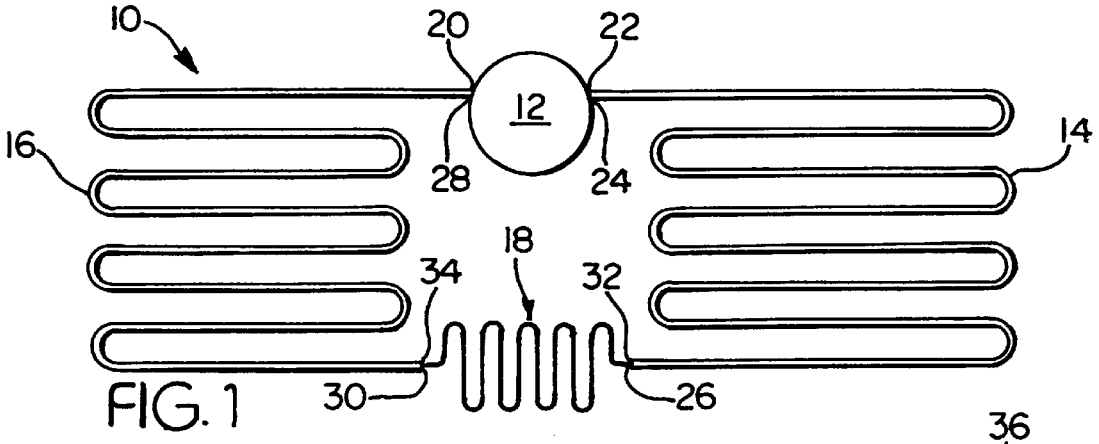

FIG. 1 illustrates a refrigeration system 10 according to the invention. The refrigeration system 10 comprises a compressor 12 to which are connected a condenser 14 and an evaporator 16. The condenser 14 and evaporator 16 are connected by a capillary tube 18 according to the invention. During the refrigeration cycle, refrigerant flows from the compressor 12, through the condenser 14, through the capillary tube 18, and into the evaporator 16, where it is once again drawn into the compressor 12 to repeat the cycle.

Looking at the refrigeration system 10 in greater detail, the compressor 12 has an inlet 20 on its low pressure or suction side and an outlet 22 on its high pressure side. The condenser 14 has an inlet 24, which is connected to the compressor outlet and a condenser outlet 26. The evaporator has an evaporator outlet 28, which is connected to the compressor inlet 20, and an evaporator inlet 30. The capillary tube 18 has an inlet 32 and an outlet 34. The capillary tube inlet 32 is connected to the condenser outlet 26 and the capillary tube outlet 34 is connected to the evaporator inlet 30 to complete the fluid path for the refrigerant in the refrigeration system 10.

During operation of the refrigeration system, the compressor draws refrigerant from the evaporator, which is typically in a gaseous state, and compresses the refrigerant and pumps it into the condenser 14. As compressed refrigerant is directed into the condenser 14 by the compressor 12, the compressed refrigerant encounters the capillary tube 18, which has an inner cross-sectional area much smaller than the inner cross-sectional area of the condenser 14 and evaporator 16. The smaller cross-sectional area of the capillary tube results in a restriction of the flow of compressed refrigerant from the condenser 14 into the evaporator 16, resulting in the build up of a relatively high pressure within the condenser 14. As the pressurized refrigerant passes from the capillary tube 18 into the evaporator, it expands in the low pressure, greater volume environment of the evaporator tube, creating a temperature decrease. In previous designs the temperature decrease occurs approximately at the point where the capillary tube connects to the evaporator. In previous designs, it is possible for the temperature decrease to occur or begin within the portion of the capillary tube very near the evaporator because of thermal conduction between the evaporator and the capillary tube and the upstream effect of the gas in the evaporator on the compressed refrigerant very near the junction of the capillary tube and the evaporator.

A problem associated with the change of state of the refrigerant from a liquid to a gas is that contaminants previously held within the liquid refrigerant are brought out of solution during the change of state to a gas. These contaminants typically deposit within the refrigeration system at the point where the temperature decreases, which in prior designs often occurs at the junction of the capillary tube and the evaporator, which can result in the clogging of the capillary tube. Historically, the depositing of the contaminants within the refrigeration system did not result in system failure for refrigeration systems using CFC refrigerants. Contamination in CFC systems generally is held in solution by the refrigerant. However, newer refrigerants such as BFC (R-134A) are more susceptible to the release or precipitation of contaminants, such as hydrocarbon contaminants, especially paraffins, which can clog the capillary tube. The BFC systems will generally fail if 20 to 50 mg of contamination are present in the sealed system.

The capillary tube 18 according to the invention is provided with a varying cross-sectional area, which permits contaminants to be deposited within the capillary tube without adversely affecting the performance of the refrigeration system. Preferably, the varying diameter increases from the capillary tube inlet toward the capillary tube outlet, and includes at least one increase, which is typically achieved by changing the effective inner diameter of the capillary tube. Thus, the capillary tube is effectively conceptually separated into a first portion having a first cross-sectional area and a second portion having a second cross-sectional area. However, if there is more than one increase in the inner cross-sectional area, there will be a corresponding number of increases in the conceptual portions of the capillary tube. It is also within the scope of the invention for the capillary tube to have a continuously increasing effective inner cross-sectional area diameter.

It has been determined that the ratio of the second cross-sectional area to the first cross-sectional area (the transition ratio) should be at least greater than or equal to 1.2 to insure that there is sufficient room in the second portion to accommodate the expected amount of contaminant contained within the refrigerant. In HFC systems, it is possible to have as much as 500 mg of contamination. Experiments have shown that this invention can tolerate this level of contamination without system failure. Additionally, the transition ratio should be less than or equal to 2.0 to insure that the second portion of the capillary tube does not effectively become an extension of the evaporator, which would negate the benefit of the variable area capillary tube.

The capillary tube according to the invention will have an approximate overall length of seven to ten feet. However, the length is dependent on a particular application and will vary. Approximately 50% to 70% of the length will be comprised of the first portion and the remainder of the length will be comprised by the second portion. For purposes of the invention, it is only important that the length of the second portion not adversely impact the capillary tube's ability to accommodate the expected amount of contaminants within the refrigerant.

Figure 2:
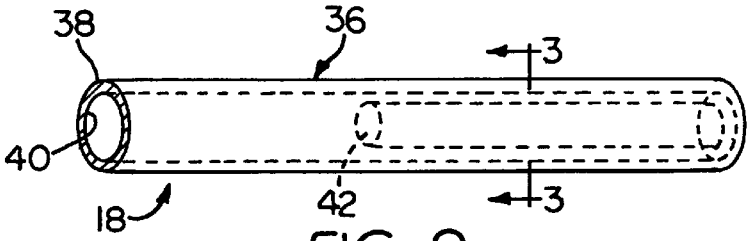
FIG. 2 illustrates a first embodiment of a capillary tube for the refrigeration system according to the invention.
Figure 3:
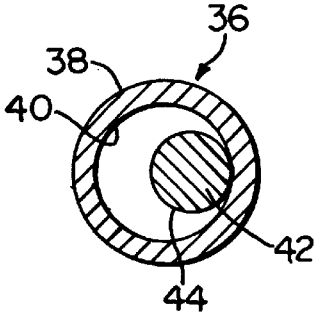
FIG. 3 is a sectional view of a capillary tube of FIG. 2 taken along lines 3—3.

FIGS. 2 and 3 illustrate a first embodiment of the capillary tube according to the invention. The first embodiment capillary tube 36 comprises an outer tube 38 having a constant inner diameter 40 and a wire 42 mounted within the outer tube 38. The wire 42 has an outer diameter 44.

The wire 42 generally extends from the capillary tube inlet 32 toward the capillary tube outlet 34 and is held in place by the serpentine structure of the capillary tube 18. The wire 42 does not extend through the entire length of the capillary tube 18. The first portion of the capillary tube 18 is defined by the portion of the capillary tube 18 in which the wire is disposed and the second portion of the capillary tube as defined by the portion of the capillary tube 18 where there is no wire. The presence of the wire 42 within the capillary tube effectively reduces the cross-sectional area of the first portion of the capillary tube. Thus, there is a transition in the cross-sectional areas from the first portion of the capillary tube to the second portion of the capillary tube at the terminal end of the wire 42.

Figure 4:
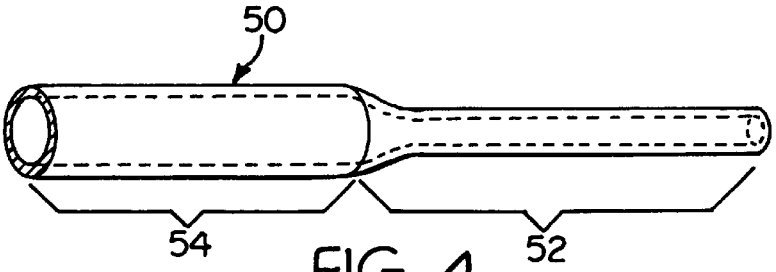
FIG. 4 is a second embodiment of a capillary tube according to the invention.

FIG. 4 illustrates a second embodiment of the capillary tube 18 according to the invention. In the second embodiment, the capillary tube 18 comprises a one-piece outer tube 50, having a first portion 52 and a second portion 54. The first portion 52 has an inner diameter which is relatively smaller than the inner diameter of the second portion 54, resulting in the first portion 52 having a cross-sectional area less than that of the second portion 54. The junction of the first portion 52 and the second portion 54 forms a transition point. The outer tube 50 is illustrated as having a constant thickness with a variable outer diameter that corresponds to the variable inner diameter. However, it is within the scope of the invention for the outer tube to have a constant outer diameter that does not vary in correspondence with the varied inner diameter.

Figure 5:
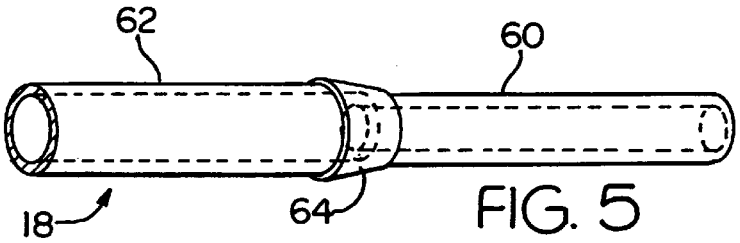
FIG. 5 is a third embodiment of a capillary tube according to the invention.

FIG. 5 illustrates a third embodiment of the capillary tube according to the invention. The third embodiment comprises a first outer tube 60 and a second outer tube 62. The first outer tube has a smaller inner diameter than the inner diameter of the second outer tube. The first and second outer tubes are connected together by a braised joint 64.

Figure 6:
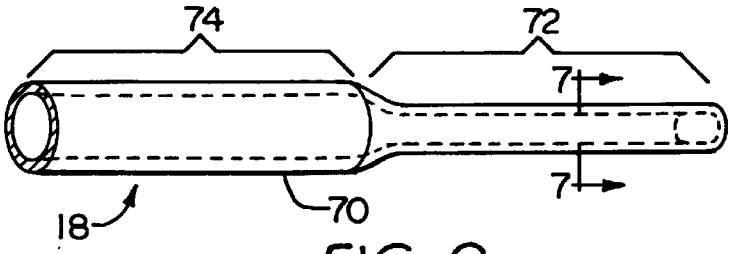
FIG. 6 is a fourth embodiment of a capillary tube according to the invention.
Figure 7:
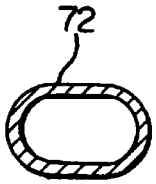
FIG. 7 is a sectional view taken along lines 7—7 of FIG. 6.

FIGS. 6 and 7 illustrate a fourth embodiment of the capillary tube 18 according to the invention. The fourth embodiment comprises an outer tube 70 whose outer diameter was originally constant. However, a first portion 72 of the outer tube 70 is rolled to reduce the inner cross-sectional area of the first portion 72. A second portion 74 is not rolled and has a cross-sectional area which is greater than that of the first portion 72.

The invention provides a simple solution to the problems associated with new refrigerants containing relativly large quantities of contaminants. The invention is preferrential to using a single large internal diameter capillary tube because the desired restriction can be provided with a minimal length of capillary tube. In order to provide the desired restriction using a single large internal diameter capillary tube, an excessive length would be required. This excessive length would inhibit heat exchange between the capillary tube and suction line in systems that use suction line heat exchangers to improve system efficiency.

As can be seen by the many different embodiments, there are a variety of different ways in which a capillary tube according to the invention can be constructed. The invention is not limited to the specific constructions illustrated.

We claim:

1. A refrigeration system comprising:

a compressor having an inlet and an outlet;

a condenser having an inlet and an outlet and the condenser inlet connected to the compressor outlet;

an evaporator having an inlet and an outlet and the evaporator outlet connected to the compressor inlet; and a capillary tube comprising at least a first portion and a second portion, the first portion having a first cross-sectional area and defining a capillary tube inlet, the second portion having a second cross-sectional area greater than the first cross-sectional area and defining a capillary tube outlet, and the capillary tube inlet is connected to the condenser outlet and the capillary tube outlet is connected to the evaporator inlet.

2. A refrigeration system as claimed in claim 1, wherein the first portion and the second portion comprise the entire length of the capillary tube.

3. A refrigeration system as claimed in claim 2, wherein the second portion constitutes less than one-half the entire length of the capillary tube.

4. A refrigeration system as claimed in claim 2, wherein the internal volume of the second portion is great enough to contain at least up to 300 mg of contaminant without clogging the capillary tube.

5. A refrigeration system as claimed in claim 1, wherein the ratio of the second cross-sectional area to the first cross-sectional area is greater than or equal to 1.2.

6. A refrigeration system as claimed in claim 5, wherein the ratio of the second cross-sectional area to the first cross-sectional area is less than or equal to 2.0.

7. A refrigeration system as claimed in claim 5, wherein the ratio of the second cross-sectional area to the first cross-sectional area is approximately equal to 1.5.

8. A refrigeration system as claimed in claim 1, wherein the capillary tube further comprises a wire positioned within the capillary tube to define the first portion and the first cross-sectional area.

9. A refrigeration system as claimed in claim 1, wherein the capillary tube comprises a one-piece tube having two discrete sections defining the first and second portions.

10. A refrigeration system as claimed in claim 1, wherein the capillary tube comprises at least two separate tubes connected together, one tube defining the first portion, and the second tube defining the second portion.

11. A refrigeration system as claimed in claim 1, wherein the capillary tube comprises a single tube having a rolled portion to define the first portion and a normal portion to define the second portion.

12. A capillary tube for a refrigeration system comprising a compressor having an inlet and an outlet, a condenser having an inlet and an outlet and the condenser inlet connected to the compressor outlet, and an evaporator having an inlet and an outlet and the evaporator outlet connected to the compressor inlet, the capillary tube comprising:

at least a first portion and a second portion, the first portion having a first cross-sectional area and defining a capillary tube inlet, the second portion having a second cross-sectional area greater than the first cross-sectional area and defining a capillary tube outlet, and the capillary tube inlet is connected to the condenser outlet and the capillary tube outlet is connected to the evaporator inlet.

13. A capillary tube as claimed in claim 12, wherein an end of the first portion defines the capillary tube inlet and an end of the second portion defines the capillary tube outlet.

14. A capillary tube as claimed in claim 12, wherein the first portion and the second portion comprise the total length of the capillary tube.

15. A capillary tube as claimed in claim 12, wherein the second portion constitutes less than one-half the total length of the capillary tube.

16. A capillary tube as claimed in claim 12, wherein the internal volume of the second portion is great enough to contain at least up to 300 mg of contaminant without clogging the capillary tube.

17. A capillary tube as claimed in claim 12, wherein the ratio of the second cross-sectional area to the first cross-sectional area is greater than or equal to 1.2.

18. A capillary tube as claimed in claim 17, wherein the ratio of the second cross-sectional area to the first cross-sectional area is less than or equal to 2.0.

19. A capillary tube as claimed in claim 18, wherein the ratio of the second cross-sectional area to the first cross-sectional area is approximately equal to 1.5.

20. A capillary tube as claimed in claim 12, wherein the capillary tube further comprises a wire positioned within the capillary tube to define the first cross-sectional area.

21. A capillary tube as claimed in claim 20, wherein the wire extends generally from the capillary tube inlet toward, but not to, the capillary tube outlet, and the first portion of the capillary tube is defined by the portion of the capillary tube containing the wire and the second portion of the capillary tube is defined by the portion of the capillary tube not containing the wire.

22. A capillary tube as claimed in claim 12, wherein the capillary tube comprises at least two separate tubes connected together, one tube defining the first portion, and the second tube defining the second portion.

23. A capillary tube as claimed in claim 12, wherein the capillary tube comprises a single tube having a shaped portion to define the first portion and a normal portion to define the second portion.

24. A capillary tube as claimed in claim 12, wherein the capillary tube comprises a one-piece tube having two conceptually discrete sections defining the first and second portions.

* * * * *